US011707138B1

(12) United States Patent
Wu

(10) Patent No.: US 11,707,138 B1
(45) Date of Patent: Jul. 25, 2023

(54) SOFA ARMREST STRUCTURE AND SOFA

(71) Applicant: Genova INC, Diamond Bar, CA (US)

(72) Inventor: Peng Wu, Shanghai (CN)

(73) Assignee: Genova INC, Diamond Bar, CA (US)

( * ) Notice: Subject to any disclaimer, the term of this patent is extended or adjusted under 35 U.S.C. 154(b) by 0 days.

(21) Appl. No.: 18/120,456

(22) Filed: Mar. 13, 2023

(30) Foreign Application Priority Data

Dec. 19, 2022 (CN) ..... 202223407219.2

(51) Int. Cl.
*A47C 17/86* (2006.01)
*A47C 17/02* (2006.01)
*A47C 17/04* (2006.01)

(52) U.S. Cl.
CPC ..... *A47C 17/86* (2013.01); *A47C 17/02* (2013.01); *A47C 17/04* (2013.01)

(58) Field of Classification Search
CPC ..... A47C 17/86; A47C 17/02; A47C 17/04; A47C 17/12
USPC ..... 5/12.1, 51.1, 52
See application file for complete search history.

(56) References Cited

U.S. PATENT DOCUMENTS 4,215,446 A * 8/1980 Mahoney ..... A61G 7/052 5/663
5,044,025 A * 9/1991 Hunsinger ..... A61G 7/052 5/663
5,097,550 A * 3/1992 Marra, Jr. ..... A61G 7/0522 5/663
5,175,897 A * 1/1993 Marra, Jr. ..... A61G 7/0524 5/663
5,191,663 A * 3/1993 Holder ..... A61G 7/0524 5/663
5,557,817 A * 9/1996 Haddock ..... A61G 7/052 5/663
5,890,244 A * 4/1999 Cartwright ..... A61G 7/0522 5/663
6,038,721 A * 3/2000 Gordon ..... A61G 7/052 5/663
6,240,580 B1 * 6/2001 Hamilton ..... A61G 7/0507 5/425

(Continued)

FOREIGN PATENT DOCUMENTS

WO WO-2012135709 A2 * 10/2012 ..... A47C 17/02
WO WO-2012135716 A2 * 10/2012 ..... A47C 17/02

*Primary Examiner* — Robert G Santos
(74) *Attorney, Agent, or Firm* — Bayramoglu Law Offices LLC

(57) ABSTRACT

A sofa armrest structure and a sofa are provided. A connection pipe is provided with a connection through hole. A first connection hole is formed in a first fixing frame and corresponds to the connection through hole. A second connection hole is formed in a second fixing frame and corresponds to the connection through hole, and an internal thread structure is formed in the second connection hole. One end of a connection rod is provided with a nut, and the other end of the connection rod is provided with an external thread structure. The end with the external thread structure of the connection rod passes through the connection through hole and the first connection hole and is connected to the internal thread structure in the second connection hole through the external thread structure. An inner chamber protection layer is detachably arranged on a fixing frame body through hook-and-loop fasteners.

16 Claims, 7 Drawing Sheets

(56) References Cited

U.S. PATENT DOCUMENTS

| | | | | |
|---|---|---|---|---|
| 6,241,317 | B1 * | 6/2001 | Wu | A47C 4/02 297/440.1 |
| 6,622,364 | B2 * | 9/2003 | Hamilton | A61G 7/0524 29/527.4 |
| 6,820,293 | B2 * | 11/2004 | Alverson | A61G 7/0507 5/663 |
| 8,777,319 | B2 * | 7/2014 | Brandtner | A47C 4/028 297/440.15 |
| 9,474,381 | B2 * | 10/2016 | Brandtner | A47C 17/02 |
| 10,117,521 | B2 * | 11/2018 | Lewis | A47C 7/54 |
| 10,694,863 | B2 * | 6/2020 | Lewis | B68G 7/05 |
| 11,406,192 | B1 * | 8/2022 | Wu | A47C 4/02 |
| 11,484,122 | B2 * | 11/2022 | Chen | A47C 4/02 |
| 11,633,315 | B2 * | 4/2023 | Schmutz | A61G 7/052 5/427 |
| 2001/0023508 | A1 * | 9/2001 | Hamilton | A61G 7/0507 5/425 |
| 2004/0060111 | A1 * | 4/2004 | Alverson | A61G 7/0524 5/425 |
| 2012/0248836 | A1 * | 10/2012 | Lejcher | A47C 17/02 206/576 |
| 2012/0248842 | A1 * | 10/2012 | Brandtner | A47C 17/86 297/452.18 |
| 2015/0130253 | A1 * | 5/2015 | Brandtner | A47C 17/02 297/452.11 |
| 2016/0249742 | A1 * | 9/2016 | Xie | A47C 4/028 297/440.23 |
| 2017/0105541 | A1 * | 4/2017 | Lewis | B68G 7/05 |
| 2019/0133335 | A1 * | 5/2019 | Lewis | A47C 31/02 |
| 2021/0267827 | A1 * | 9/2021 | Schmutz | A61G 7/052 |
| 2021/0274942 | A1 * | 9/2021 | Ha | A47C 17/02 |
| 2022/0104622 | A1 * | 4/2022 | Chen | A47C 13/005 |

* cited by examiner

SOFA ARMREST STRUCTURE AND SOFA

CROSS REFERENCE TO THE RELATED APPLICATIONS

This application is based upon and claims priority to Chinese Patent Application No. 202223407219.2, filed on Dec. 19, 2022, the entire contents of which are incorporated herein by reference.

TECHNICAL FIELD

The present disclosure relates to the technical field of sofas, specifically to a sofa armrest structure and a sofa.

BACKGROUND

At present, due to the demand for comfort, sofas generally have a soft package part, so the sofa size is large, which makes the products occupy a very large volume in the process of warehousing and transportation, thereby increasing the cost. The prior sofa is configured in the way that sofa armrests are detachably arranged on a sofa's main body. When packing and transporting, the sofa's main body and the sofa armrests are packed respectively, but the sofa armrest is still a spatial structure. Thus, when transporting, the whole armrest needs to be packaged, which results in a large packaging size and a high transportation cost.

SUMMARY

Given the defects in the prior art, an objective of the present disclosure is to provide a sofa armrest structure and a sofa.

The present disclosure provides a sofa armrest structure, including a fixing frame body, an inner chamber protection layer, and a sofa armrest covering. The fixing frame body includes a first fixing frame and a second fixing frame. The first fixing frame and the second fixing frame are connected by a connection assembly. The connection assembly includes a plurality of connection rods and a plurality of connection pipes.

Each of the connection pipes is provided with a connection through hole. A first connection hole is formed in the first fixing frame and corresponds to the connection through hole. A second connection hole is formed in the second fixing frame and corresponds to the connection through hole, and an internal thread structure is formed in the second connection hole. One end of the connection rod is provided with a nut, and the other end of the connection rod is provided with an external thread structure.

The end with the external thread structure of the connection rod passes through the connection through hole and the first connection hole and is connected to the internal thread structure in the second connection hole through the external thread structure.

The inner chamber protection layer is detachably arranged on the fixing frame body through hook-and-loop fasteners. The sofa armrest covering is detachably arranged on the fixing frame body through hook-and-loop fasteners, and the sofa armrest covering is covered on the outer surface of the inner chamber protection layer.

Preferably, the first fixing frame or the second fixing frame is provided with a fixing rod. A connection clamping slot structure is detachably arranged on the fixing rod, and the connection clamping slot structure is configured for connecting a main body of a sofa.

Preferably, the connection clamping slot structure is arranged on the fixing rod by a bolt.

Preferably, each of the inner chamber protection layer and the sofa armrest covering is provided with an installation round hole. The connection clamping slot structure is provided with an installation fixing hole. The fixing rod is provided with a connection thread hole.

The bolt passes through the installation fixing hole and the installation round hole and is connected to the connection thread hole.

Preferably, the first fixing frame or the second fixing frame is welded with the fixing rod.

Preferably, the first fixing frame is formed by bending a square pipe many times, and the head and tail of the square pipe are connected by welding.

Preferably, the first fixing frame includes a first transverse bar structure, a second transverse bar structure, a first vertical bar structure, a second vertical bar structure, a first inclined bar structure, a second inclined bar structure, a first arc structure, a second arc structure, a third arc structure, a fourth arc structure, a fifth arc structure, and a sixth arc structure.

One end of the first transverse bar structure is connected to one end of the first vertical bar structure through the first arc structure, and the other end of the first transverse bar structure is connected to one end of the first inclined bar structure through the second arc structure.

The other end of the first vertical bar structure is connected to one end of the second transverse bar structure through the third arc structure, and the other end of the second transverse bar structure is connected to one end of the second inclined bar structure through the fourth arc structure.

The other end of the second inclined bar structure is connected to one end of the second vertical bar structure through the fifth arc structure, and the other end of the second vertical bar structure is connected to the other end of the first inclined bar structure through the sixth arc structure.

Preferably, the second fixing frame is formed by bending a square pipe many times, and the head and tail of the square pipe are connected by welding.

The second fixing frame is structurally identical to the first fixing frame, and the size of the second fixing frame is identical to the size of the first fixing frame.

The present disclosure further provides a sofa, including the aforementioned sofa armrest structure.

Compared to the prior art, the advantages of the present disclosure are as follows:

1. The armrest structure of the present disclosure can be disassembled into a plurality of small structures, which is convenient for transportation.

2. By adopting a detachable structure, the present disclosure reduces the transport volume of the sofa after disassembly, which is beneficial to the control of transportation and warehousing costs.

3. The present disclosure adopts a detachable structure to improve the versatility of product parts and realize the assembly of the products in different sizes by replacing the corresponding parts, which is beneficial to improve production efficiency, reduce production cost, and ensure the stability of the product quality.

4. The present disclosure adopts a quick-detachable structure of the inner chamber covering and the sofa armrest covering, which is convenient for cleaning and replacement.

BRIEF DESCRIPTION OF THE DRAWINGS

Other features, objectives, and advantages of the present disclosure will become more apparent by reading the detailed descriptions of the non-restrictive embodiments in light of the following figures.

In the figures.

Figure 1:
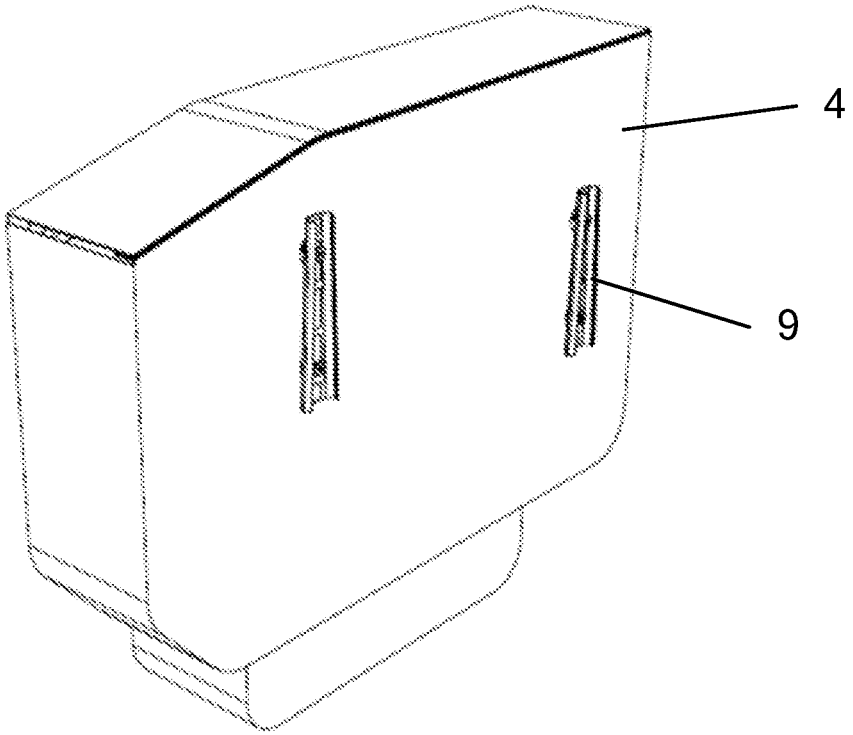
FIG. 1 is a schematic diagram showing the overall structure of a sofa armrest structure according to the present disclosure.

first fixing frame 1; first transverse bar structure 101; second transverse bar structure 102; first vertical bar structure 103; second vertical bar structure 104; first inclined bar structure 105; second inclined bar structure 106; first arc structure 107; second arc structure 108; third arc structure 109; fourth arc structure 110; fifth arc structure 111; sixth arc structure 112;

second fixing frame 2;

inner chamber protection layer 3;

sofa armrest covering 4;

connection rod 5;

connection pipe 6;

hook-and-loop fasteners 7;

fixing rod 8;

connection clamping slot structure 9;

bolt 10; and installation round hole 11.

DETAILED DESCRIPTION OF THE EMBODIMENTS

The present disclosure is described in detail as follows in combination with specific embodiments. The following embodiments will help those skilled in the art to further understand the present disclosure but do not limit the present disclosure in any form. For those having ordinary skill in the art, several modifications and improvements may be made without departing from the idea of the present disclosure. These modifications and improvements all fall within the protection scope of the present disclosure.

Figure 2:
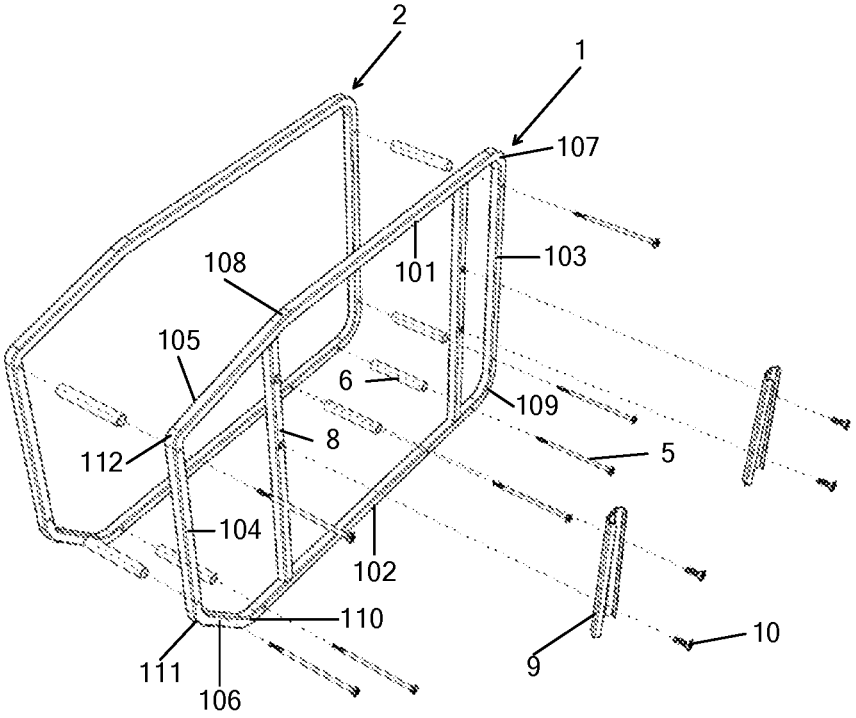
FIG. 2 is a schematic diagram showing the structure of a fixing frame body according to the present disclosure.
Figure 3:
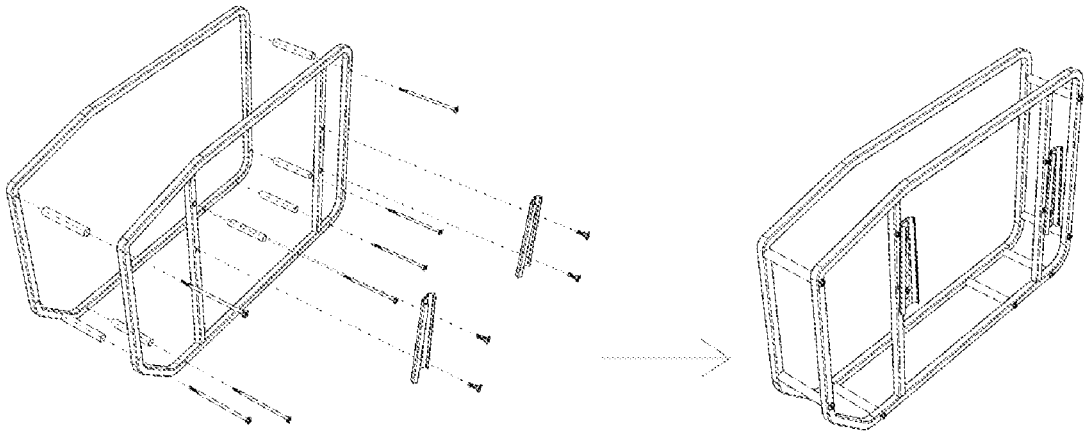
FIG. 3 is a schematic diagram showing the installation of the fixing frame body according to the present disclosure.
Figure 4:
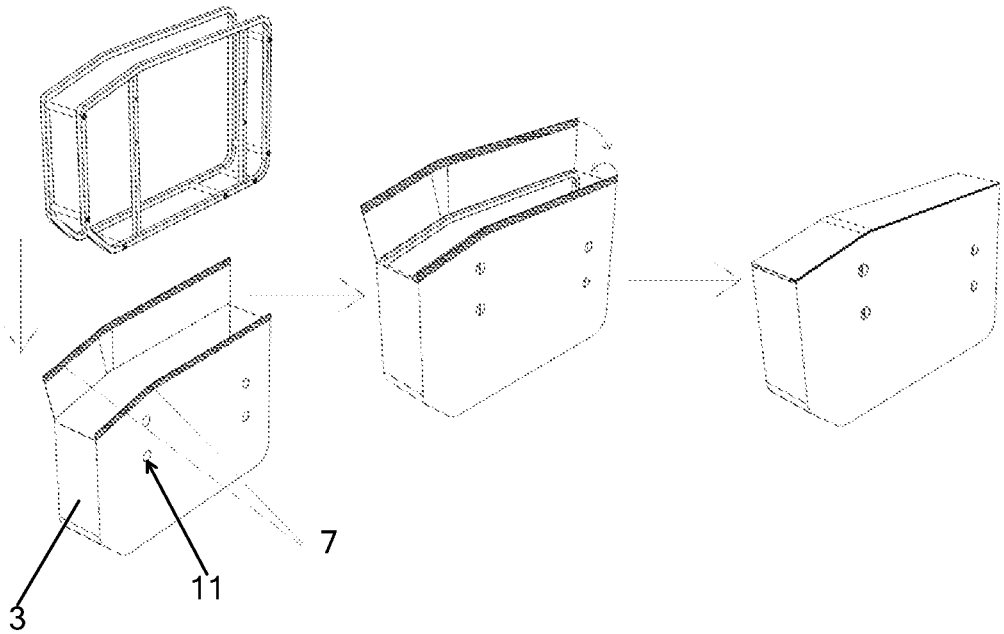
FIG. 4 is a schematic diagram showing the installation of an inner chamber protection layer according to the present disclosure.
Figure 5:
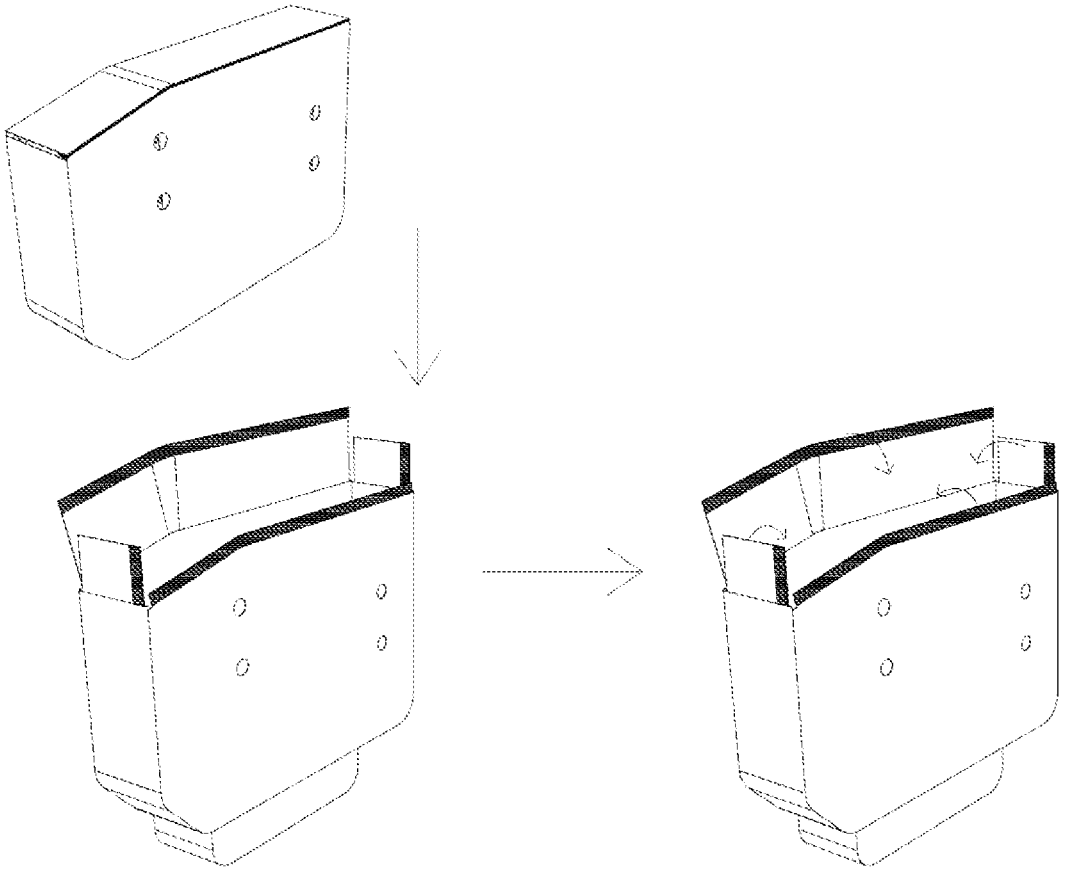
FIG. 5 is a schematic diagram showing the installation of a covering layer according to the present disclosure.
Figure 6:
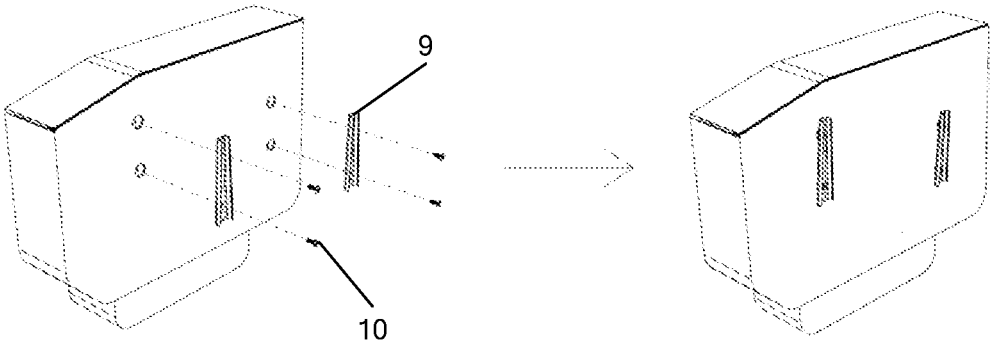
FIG. 6 is a schematic diagram showing the installation of a connection clamping slot structure according to the present disclosure.
Figure 7:
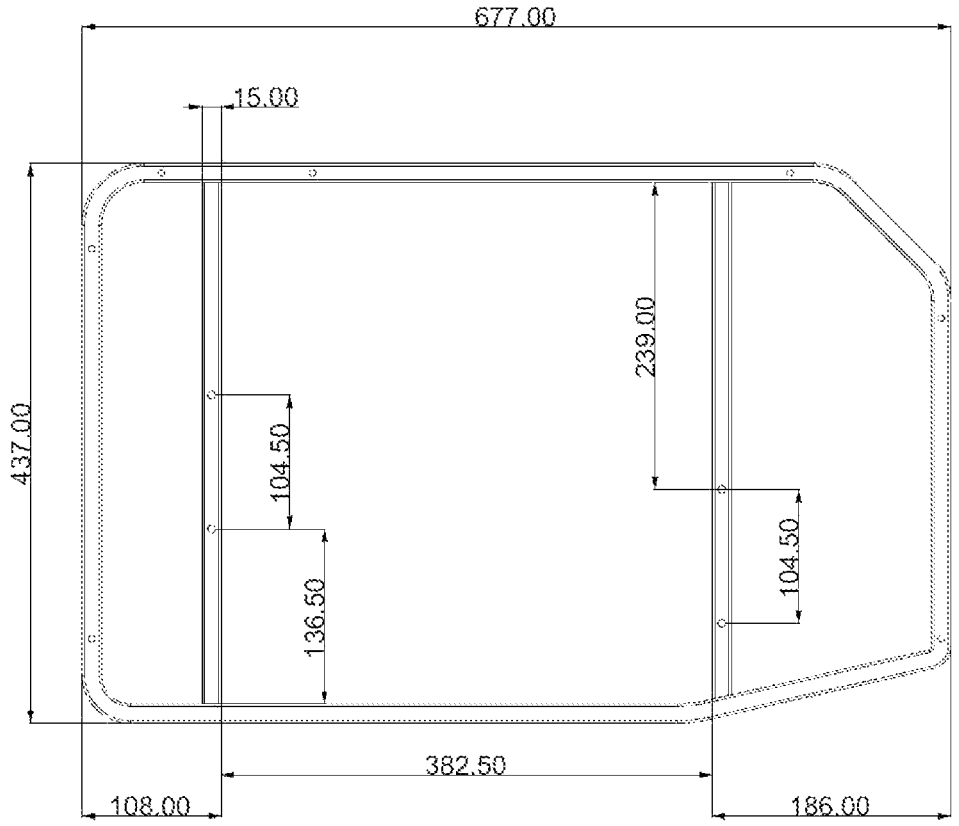
FIG. 7 is a first schematic diagram showing the size of a fixing frame body in an embodiment.
Figure 8:
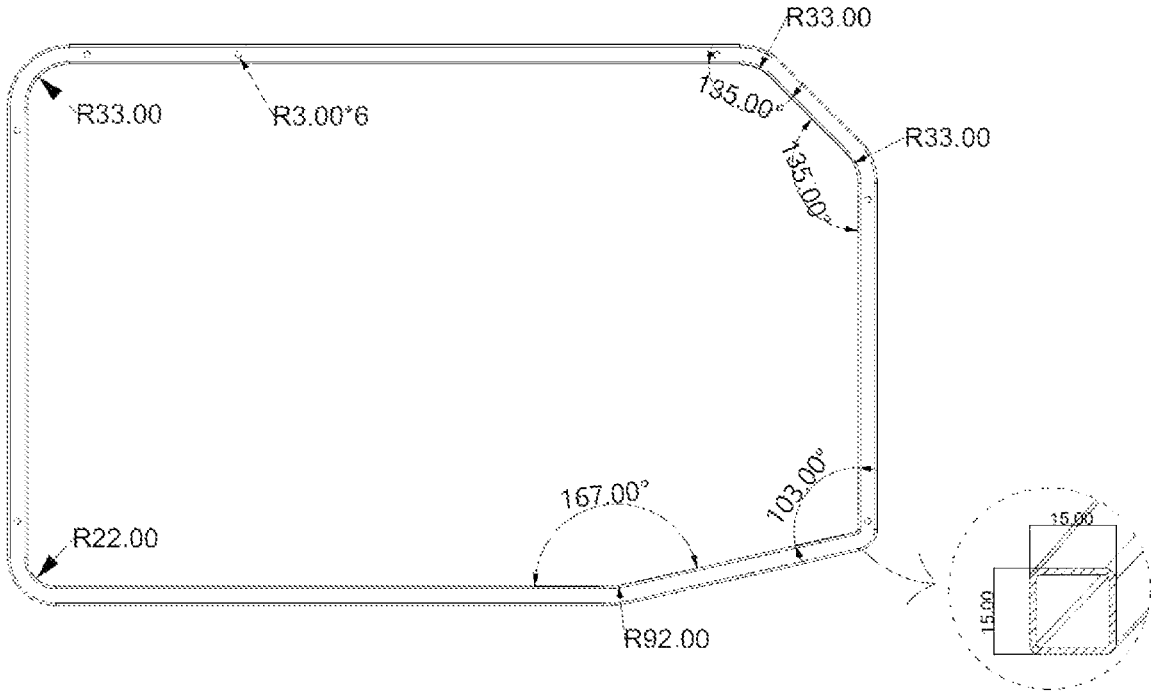
FIG. 8 is a second schematic diagram showing the size of the fixing frame body in the embodiment.
Figure 9A:
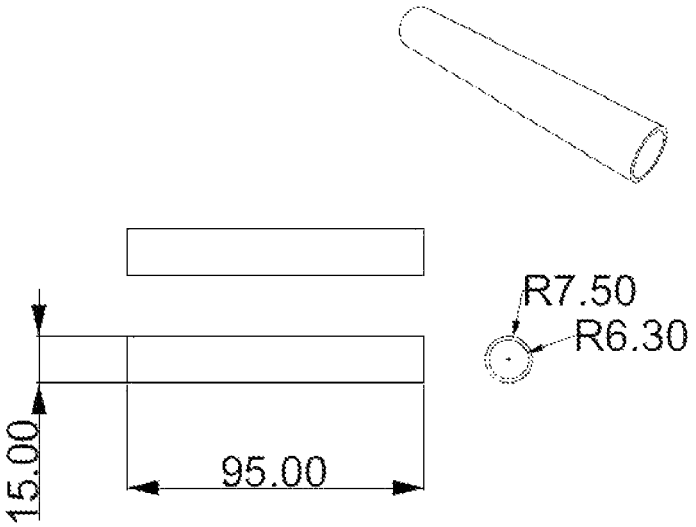
FIGS. 9A-9B are schematic diagrams showing the size of a connection pipe and the size of a connection rod in an embodiment.
Figure 9B:
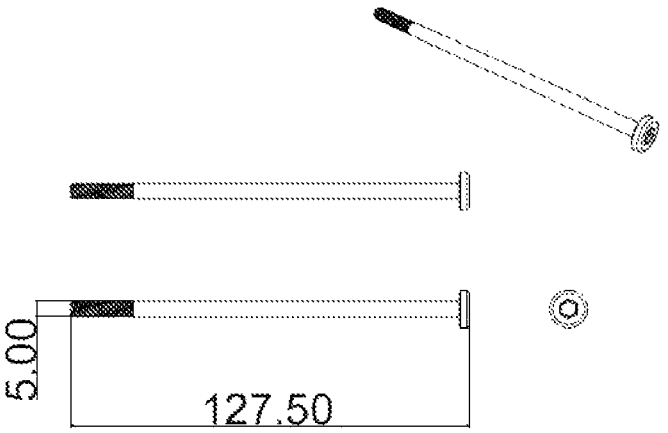

Embodiment I:

As shown in FIGS. 1-9, this embodiment provides a sofa armrest structure. The sofa armrest structure includes a fixing frame body, the inner chamber protection layer 3, and the sofa armrest covering 4. The fixing frame body includes the first fixing frame 1 and the second fixing frame 2. The first fixing frame 1 and the second fixing frame 2 are connected by a connection assembly. The connection assembly includes a plurality of connection rods 5 and a plurality of connection pipes 6. Each of the connection pipes 6 is provided with a connection through hole. A first connection hole is formed in the first fixing frame 1 and corresponds to the connection through hole. A second connection hole is formed in the second fixing frame 2 and corresponds to the connection through hole, and an internal thread structure is formed in the second connection hole. One end of the connection rod 5 is provided with a nut, and the other end of the connection rod 5 is provided with an external thread structure. The end with the external thread structure of the connection rod 5 passes through the connection through hole and the first connection hole and is connected to the internal thread structure in the second connection hole through the external thread structure. The inner chamber protection layer 3 is detachably arranged on the fixing frame body through the hook-and-loop fasteners 7. The sofa armrest covering 4 is detachably arranged on the fixing frame body through the hook-and-loop fasteners 7, and the sofa armrest covering 4 covers the outer surface of the inner chamber protection layer 3. In this embodiment, the number of the connection pipes 6 is seven, and the connection pipes are round. The leather material of the sofa armrest covering 4 can be genuine leather, imitation leather, cloth material, and the like.

The first fixing frame 1 is formed by bending a square pipe many times, and the head and tail of the square pipe are connected by welding. The first fixing frame 1 includes the first transverse bar structure 101, the second transverse bar structure 102, the first vertical bar structure 103, the second vertical bar structure 104, the first inclined bar structure 105, the second inclined bar structure 106, the first arc structure 107, the second arc structure 108, the third arc structure 109, the fourth arc structure 110, the fifth arc structure 111, and the sixth arc structure 112.

One end of the first transverse bar structure 101 is connected to one end of the first vertical bar structure 103 through the first arc structure 107, and the other end of the first transverse bar structure 101 is connected to one end of the first inclined bar structure 105 through the second arc structure 108. The other end of the first vertical bar structure 103 is connected to one end of the second transverse bar structure 102 through the third arc structure 109, and the other end of the second transverse bar structure 102 is connected to one end of the second inclined bar structure 106 through the fourth arc structure 110. The other end of the second inclined bar structure 106 is connected to one end of the second vertical bar structure 104 through the fifth arc structure 111, and the other end of the second vertical bar structure 104 is connected to the other end of the first inclined bar structure 105 through the sixth arc structure 112.

The second fixing frame 2 is formed by bending a square pipe many times, and the head and tail of the square pipe are connected by welding. The second fixing frame 2 is structurally identical to the first fixing frame 1, and the size of the second fixing frame 2 is identical to the size of the first fixing frame 1.

Two connection pipes 6 are arranged between the first vertical bar structure 103 of the first fixing frame 1 and the first vertical bar structure 103 of the second fixing frame 2. Two connection pipes 6 are arranged between the second vertical bar structure 104 of the first fixing frame 1 and the second vertical bar structure 104 of the second fixing frame 2. Three connection pipes 6 are arranged between the second transverse bar structure 102 of the first fixing frame 1 and the second transverse bar structure 102 of the second fixing frame 2.

The first fixing frame 1 or the second fixing frame 2 is provided with the fixing rod 8. The connection clamping slot structure 9 is detachably arranged on the fixing rod 8, and the connection clamping slot structure 9 is configured for connecting the main body of the sofa. The width of the connection clamping slot structure 9 gradually increases from one end to the other end. The main body of the sofa is provided with a structure clamped and matched with the connection clamping slot structure 9.

The connection clamping slot structure 9 is arranged on the fixing rod 8 by the bolt 10. Each of the inner chamber protection layer 3 and the sofa armrest covering 4 is provided with the installation round hole 11. The connection clamping slot structure 9 is provided with an installation fixing hole. The fixing rod 8 is provided with a connection thread hole. The bolt 10 passes through the installation fixing hole and the installation round hole 11 and is connected to the connection thread hole. The first fixing frame 1 or the second fixing frame 2 is welded with the fixing rod 8.

Working principle:

For transportation, the inner chamber protection layer 3 and the sofa armrest covering 4 are detached from the fixing frame body, and the plurality of connection rods 5 is unscrewed and pulled out from the connection through holes of the connection pipes 6 to complete the disassembly between the first fixing frame 1, the second fixing frame 2, and the connection pipes 6. The inner chamber protection layer 3, the sofa armrest covering 4, the first fixing frame 1, the second fixing frame 2, and the connection pipes 6 are packed and transported, which reduces the packaging size and improves the convenience of transportation.

When in use, an end with the external thread structure of the connection rod 5 successively passes through the connection through hole and the first connection hole, and the end of the connection rod 5 is fixed on the second fixing frame through the external thread structure and the internal thread structure, so that the first fixing frame 1, the second fixing frame 2 and the connection pipes 6 are relatively fixed to complete the assembly of the main body of the fixing frame. Subsequently, the inner chamber protection layer 3 is wrapped on the fixing frame body. The inner chamber protection layer 3 completes encapsulation by the hook-and-loop fasteners. Finally, the sofa armrest covering 4 is wrapped on the outer surface of the inner chamber protection layer 3 to complete encapsulation by the hook-and-loop fasteners.

An embodiment of the present disclosure also provides a sofa, including the aforementioned sofa armrest structure.

The armrest structure of the present disclosure can be disassembled into a plurality of small structures, which is convenient for transportation.

In the description of the present disclosure, it should be understood that the orientation or position relationship as described by the terms "over", "under", "front", "back", "left", "right", "vertical", "horizontal", "top", "bottom", "inside", "outside", and the like is based on the orientation or position relationship shown in the drawings, only for facilitating the description of the present disclosure and simplifying the description, not indicating or implying that the device or element referred to must have a specific orientation and be constructed and operated in the specific orientation, and thus cannot be understood as a restriction on the present disclosure.

The specific embodiments of the present disclosure are described above. It should be understood that the present disclosure is not limited to the above specific embodiments, and those skilled in the art may make various changes or modifications within the scope of the claims, which does not affect the substantial content of the present disclosure. In case of no conflict, the embodiments of the present disclosure and the features in the embodiments may be arbitrarily combined with each other.

What is claimed is:

1. A sofa armrest structure, comprising a fixing frame body, an inner chamber protection layer, and a sofa armrest covering; wherein the fixing frame body comprises a first fixing frame and a second fixing frame; the first fixing frame and the second fixing frame are connected by a connection assembly; the connection assembly comprises a plurality of connection rods and a plurality of connection pipes;

each of the plurality of connection pipes is provided with a connection through hole; a first connection hole is formed in the first fixing frame and corresponds to the connection through hole; a second connection hole is formed in the second fixing frame and corresponds to the connection through hole, and an internal thread structure is formed in the second connection hole; and a first end of each of the plurality of connection rods is provided with a nut, and a second end of each of the plurality of connection rods is provided with an external thread structure;

an end with the external thread structure of each of the plurality of connection rods passes through the connection through hole and the first connection hole, and the end with the external thread structure is connected to the internal thread structure in the second connection hole through the external thread structure; and the inner chamber protection layer is detachably arranged on the fixing frame body through first hook-and-loop fasteners, the sofa armrest covering is detachably arranged on the fixing frame body through second hook-and-loop fasteners, and the sofa armrest covering covers an outer surface of the inner chamber protection layer.

2. The sofa armrest structure according to claim 1, wherein the first fixing frame or the second fixing frame is provided with a fixing rod, a connection clamping slot structure is detachably arranged on the fixing rod, and the connection clamping slot structure is configured for connecting a main body of a sofa.

3. The sofa armrest structure according to claim 2, wherein the connection clamping slot structure is arranged on the fixing rod by a bolt.

4. The sofa armrest structure according to claim 3, wherein each of the inner chamber protection layer and the sofa armrest covering is provided with an installation round hole; the connection clamping slot structure is provided with an installation fixing hole; and the fixing rod is provided with a connection thread hole; and the bolt passes through the installation fixing hole and the installation round hole and is connected to the connection thread hole.

5. The sofa armrest structure according to claim 2, wherein the first fixing frame or the second fixing frame is welded with the fixing rod.

6. The sofa armrest structure according to claim 1, wherein the first fixing frame is formed by bending a first square pipe many times, and a head and a tail of the first square pipe are connected by welding.

7. The sofa armrest structure according to claim 6, wherein the first fixing frame comprises a first transverse bar structure, a second transverse bar structure, a first vertical bar structure, a second vertical bar structure, a first inclined bar structure, a second inclined bar structure, a first arc structure, a second arc structure, a third arc structure, a fourth arc structure, a fifth arc structure, and a sixth arc structure;

a first end of the first transverse bar structure is connected to a first end of the first vertical bar structure through the first arc structure, and a second end of the first transverse bar structure is connected to a first end of the first inclined bar structure through the second arc structure;

a second end of the first vertical bar structure is connected to a first end of the second transverse bar structure through the third arc structure, and a second end of the second transverse bar structure is connected to a first end of the second inclined bar structure through the fourth arc structure; and a second end of the second inclined bar structure is connected to a first end of the second vertical bar structure through the fifth arc structure, and a second end of the second vertical bar structure is connected to a second end of the first inclined bar structure through the sixth arc structure.

8. The sofa armrest structure according to claim 7, wherein the second fixing frame is formed by bending a second square pipe many times, and a head and a tail of the second square pipe are connected by welding; and the second fixing frame is structurally identical to the first fixing frame, and a size of the second fixing frame is identical to a size of the first fixing frame.

9. A sofa, comprising the sofa armrest structure according to claim 1.

10. The sofa according to claim 9, wherein in the sofa armrest structure, the first fixing frame or the second fixing frame is provided with a fixing rod, a connection clamping slot structure is detachably arranged on the fixing rod, and the connection clamping slot structure is configured for connecting a main body of the sofa.

11. The sofa according to claim 10, wherein in the sofa armrest structure, the connection clamping slot structure is arranged on the fixing rod by a bolt.

12. The sofa according to claim 11, wherein in the sofa armrest structure, each of the inner chamber protection layer and the sofa armrest covering is provided with an installation round hole; the connection clamping slot structure is provided with an installation fixing hole; and the fixing rod is provided with a connection thread hole; and the bolt passes through the installation fixing hole and the installation round hole and is connected to the connection thread hole.

13. The sofa according to claim 10, wherein in the sofa armrest structure, the first fixing frame or the second fixing frame is welded with the fixing rod.

14. The sofa according to claim 9, wherein in the sofa armrest structure, the first fixing frame is formed by bending a first square pipe many times, and a head and a tail of the first square pipe are connected by welding.

15. The sofa according to claim 14, wherein in the sofa armrest structure, the first fixing frame comprises a first transverse bar structure, a second transverse bar structure, a first vertical bar structure, a second vertical bar structure, a first inclined bar structure, a second inclined bar structure, a first arc structure, a second arc structure, a third arc structure, a fourth arc structure, a fifth arc structure, and a sixth arc structure;

a first end of the first transverse bar structure is connected to a first end of the first vertical bar structure through the first arc structure, and a second end of the first transverse bar structure is connected to a first end of the first inclined bar structure through the second arc structure;

a second end of the first vertical bar structure is connected to a first end of the second transverse bar structure through the third arc structure, and a second end of the second transverse bar structure is connected to a first end of the second inclined bar structure through the fourth arc structure; and a second end of the second inclined bar structure is connected to a first end of the second vertical bar structure through the fifth arc structure, and a second end of the second vertical bar structure is connected to a second end of the first inclined bar structure through the sixth arc structure.

16. The sofa according to claim 15, wherein in the sofa armrest structure, the second fixing frame is formed by bending a second square pipe many times, and a head and a tail of the second square pipe are connected by welding; and the second fixing frame is structurally identical to the first fixing frame, and a size of the second fixing frame is identical to a size of the first fixing frame.

* * * * *